United States Patent [19]

Buckmann

[11] 4,288,202

[45] Sep. 8, 1981

[54] FAN HAVING INTERNAL POLYHEDRAL STRUT FRAME

[75] Inventor: Paul S. Buckmann, Roseville, Calif.

[73] Assignee: Aerojet-General Corporation, LaJolla, Calif.

[21] Appl. No.: 807,961

[22] Filed: Jun. 20, 1977

[51] Int. Cl.[3] ..... F01D 25/16; F01D 25/24

[52] U.S. Cl. ..... 415/142; 415/219 C; 415/206

[58] Field of Search ..... 415/97, 98, 142, 206, 415/219 C; 248/14, 17, 18, 555, 556

[56] References Cited

U.S. PATENT DOCUMENTS

| | | | |
|---|---|---|---|
| 679,499 | 7/1901 | Davidson | 415/97 |
| 2,359,822 | 10/1944 | Ross | 248/555 |
| 2,404,609 | 7/1946 | Whittle | 415/219 C |
| 2,565,733 | 8/1951 | Korsberg | 248/556 |
| 2,965,338 | 12/1960 | McLean | 248/556 |
| 3,139,832 | 7/1964 | Saunders . | |
| 3,178,099 | 4/1965 | Child . | |
| 3,360,237 | 12/1967 | Surber et al. . | |
| 3,485,443 | 12/1969 | Earhart . | |
| 3,627,442 | 12/1971 | Brandt . | |
| 3,653,116 | 4/1972 | Lov et al. . | |
| 3,708,242 | 1/1973 | Bruneau et al. . | |
| 3,778,185 | 12/1973 | Plowman et al. . | |

FOREIGN PATENT DOCUMENTS

| | | | |
|---|---|---|---|
| 559553 | 9/1932 | Fed. Rep. of Germany | 415/219 C |

*Primary Examiner*—Richard E. Gluck
*Attorney, Agent, or Firm*—John S. Bell

[57] ABSTRACT

Several embodiments of high efficiency fans having lightweight housings supported and interconnected with their impellers by star-shaped frames disposed inside the fans, or in other words inside the areas defined by the fan housings, are illustrated herein. The use of a support frame inside the fan permits a much lighter construction than is possible with an outside frame, because the support members are in tension rather than compression and bending forces on different portions of the housing balance each other. To further minimize weight, the fans include hollow support rings and diffusers that receive air from the fan impeller and are partially supported by that air against fan pressure loads.

9 Claims, 4 Drawing Figures

FAN HAVING INTERNAL POLYHEDRAL STRUT FRAME

LICENSE RIGHTS

This invention was developed under subcontract K-00019-NR to Navy prime contract N00024-76-C-0924, and the Government is thereby licensed to practice this invention in accordance with the terms of that prime contract.

BACKGROUND OF THE INVENTION

1. Field of the Invention

Fans, compressors, superchargers, blowers, and the like, all referred to herein generically as fans.

2. Brief Description of the Prior Art

Fans designed to provide either a high pressure, a high flow rate, or high output efficiency are typically large, heavy, thick-walled structures. Heavy construction is required to handle the air flows in high pressure and flow rate embodiments, and to permit sufficiently high rigidities and tolerances when high efficiency is desired to prevent significant efficiency loss through leakage or backflow between the fan impeller and housing.

Support frames have been utilized on the outsides of some prior art fans to reduce the weight and size needed to achieve desired strength, rigidity, and performance levels. But, unfortunately, external frames provide only limited support and moderate reduction in the weight and size required for a particular performance. Struts that run alongside housing walls are subject to bending moments and will not effectively offset those moments unless quite heavy construction is used. Struts that extend toward housing walls from a bearing flange or other base spaced from those walls so that the strut ends abut the housing at discrete points, are compressed by pressures inside the housing and thus require heavy bearing or other support bases. Furthermore, they provide support at only discrete positions. Thick walls or plates are thus often needed to offset strong bending moments between those support points.

SUMMARY OF THE INVENTION

This invention provides fans having improved structural and performance characteristics by utilizing internal support frames, triangular construction in both the support frame and other components, hollow elements, and fan air pressure for support of those elements, to optimize strength, weight, stiffness, and efficiency. More specifically, support frames having struts arranged in star-shaped or equivalent patterns consisting of a series of adjacent triangles are disposed in side the fans illustrated herein. This frame placement and design provides axial, radial and torsional rigid support with a minimum number of structural elements, balances forces acting against different portions of the housing, facilitates lightweight construction, and does not significantly interfere with fan air flow or degrade performance. And, as is illustrated by the differences between the embodiments shown herein, substantial variation in the strut positioning and polyhedral shape of such support frames is possible to accommodate different fan designs.

The fans illustrated herein also include hollow support rings and diffusers that have triangular and generally frusto conical shapes, respectively, for strength and rigidity. These are positioned in order to provide a compact and efficient package, with the frame struts projecting through different walls to support surfaces via openings that are sufficiently large so that impeller air will create pressures inside of those elements that are roughly equal to the pressure of the main air flow through the fan. This further reduces the weight and strength requirements of the fan construction.

This invention can be utilized beneficially in any size, efficiency or performance level fan embodiment. And, different embodiments can be constructed utilizing different numbers and combinations of the features of this invention. But, as illustration of the advantages provided by this invention, it has been determined from a detailed design study and weight analysis for a full scale model, and construction of a one-twelfth scale test model, of an embodiment of the fan illustrated in FIGS. 1 and 2, designed to deliver a 7,000 cu.ft. per second air flow at 600 lbs. per sq.ft. pressure, that such fan will operate with 85% efficiency, and weigh only eight thousand eight hundred lbs. This light weight was attained utilizing all of the features of this invention discussed in the two preceding paragraphs and illustrated in FIGS. 1 and 2, and lightweight materials made feasible by the strength and simplicity of that design. And, it is on the order of only 10% of the weight of typical prior art thick-walled and external frame fan embodiments designed to provide similar operation.

BRIEF DESCRIPTION OF THE DRAWINGS

The objects, features, and advantages of this invention will become further apparent from the following description of the accompanying drawings, of which.

DETAILED DESCRIPTION OF THE DRAWINGS

Figure 1:
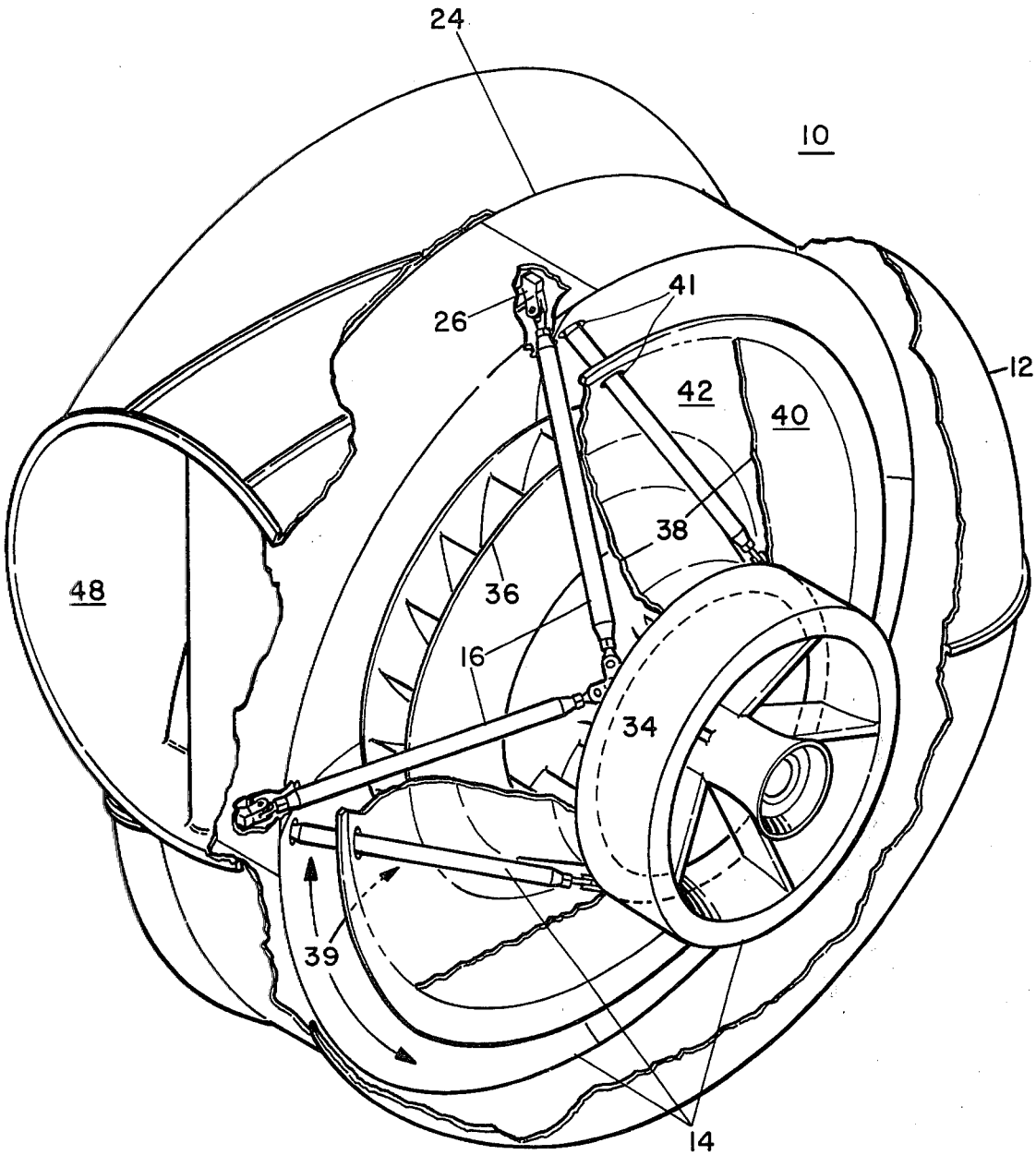
FIG. 1 is a schematic, partially cutaway, perspective illustration of a double inlet, radial flow fan.
Figure 2:
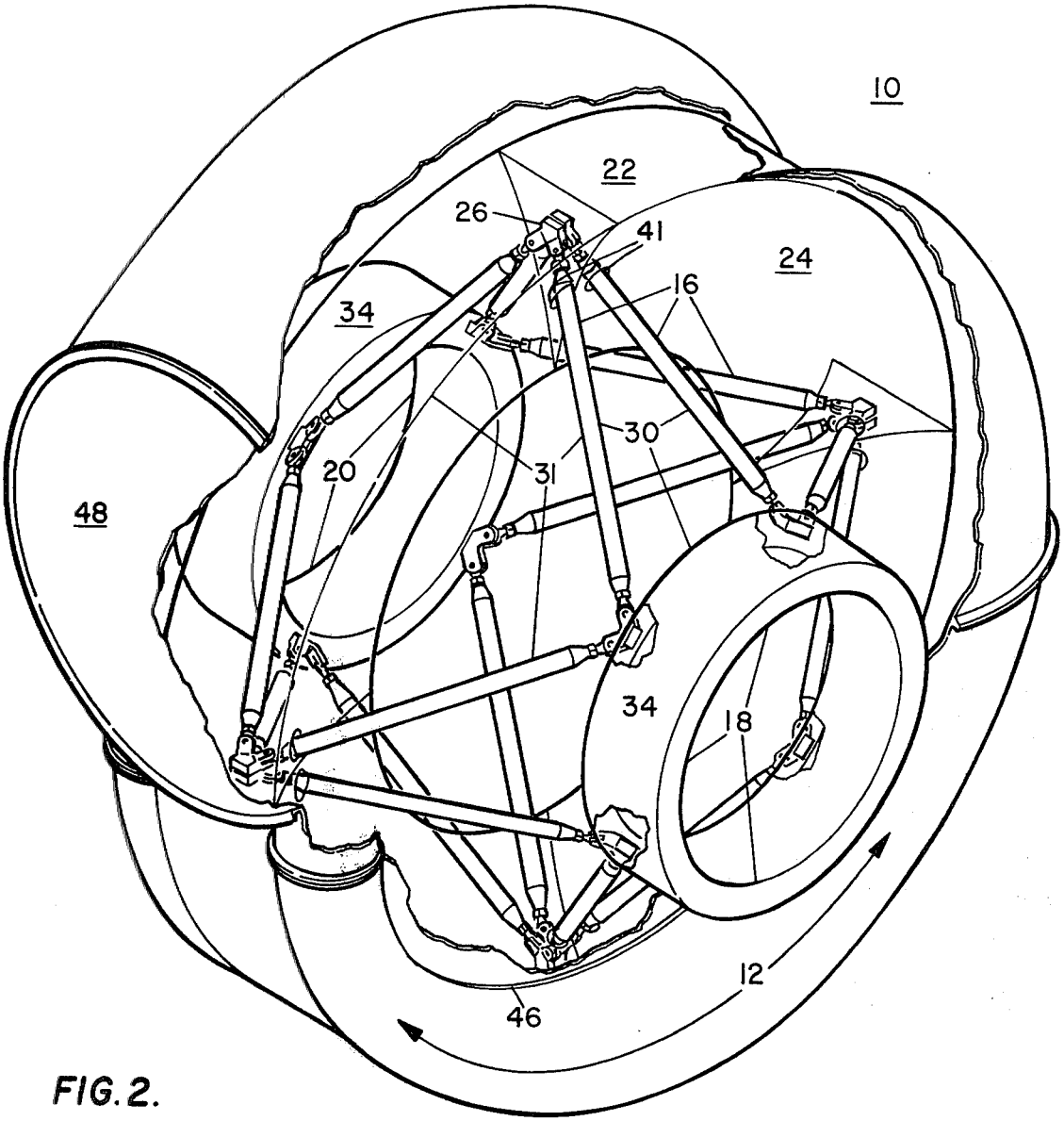
FIG. 2 is a schematic, partially cutaway, perspective illustration of the housing and support frame of the fan shown in FIG. 1.

FIG. 1 illustrates a double inlet, radial flow fan 10 having a snail shell shaped housing 12 and a housing support frame 14, shown separately in FIG. 2 for clarity. The support frame 14 includes struts 16 that extend from air inlets 18 and 20 on opposite sides of the fan housing or volute 12, and are joined to each other and attached to surface 22 of a frame support ring 24 by clevises 26. Struts 16 define a four-pointed star pattern comprised of points 30. Those points 30 and areas 31 between adjacent star points define opposed triangles that provide frame 14 with a rigid polyhedral shape or geometric surface. The ring 24 is hollow and has a triangular shape for strength and aerodynamic profile. The fan 10 also includes rings 34 encircling the fan air inlets 18 and 20 and supporting struts 16; a radial flow rotor or impeller 36 rotatably mounted in rings 34; and a hollow diffuser element 38 that cooperates with a corresponding element (not shown) extending from opposite inlet 20 to form an air diffusing slot 39 encircling rotor 36.

Diffuser element 38 is formed by surfaces 40 and 42 and has an approximately frusto conical configuration for strength. But, surface 42 is bent somewhat from that shape to provide a smooth air flow and cause the width of a slot 39 to increase with displacement from rotor 36 so that the velocity and dynamic pressure of air passing through that slot into volute 12 are decreased and static pressure is increased. The width of slot 39 does not vary with circumferal displacement about the impeller 36. This causes all air entering volute 12 at different points around the circumference of impeller to enter that volute at the same constant velocity. To further provide for a constant velocity, volute 12 interconnects with conical diffuser surface 40 along a joint 46 that spirals toward the impeller axis with displacement toward fan outlet 48 to provide housing 12 with a snail shell shape, or in other words with a flow path having a cross-sectional area that increases to accommodate the addition of air from impeller 36 to the main air flow through volute 12 as that air flows toward outlet 48.

In operation, air is drawn into the fan 10 through inlets 18 and 20 and pumped radially outward by impeller 36 toward outlet 48. A portion of this air enters the hollow support ring 24 and diffuser 38 through openings 41 encircling struts 16 and establishes pressures within those elements that provide support and prevent them from being crushed or distorted. Frame 14 supports volute 12 against internal air pressure and maintains the positions of that volute and impeller 36, with both the frame struts 16 and volute placed in tension by air pressure within fan 10. The intercepting triangles defined by the adjacent points 30 and areas 31 intermediate those points of frame 14 prevent unwanted torsion or rotation of housing 12 with respect to impeller 36 about the impeller axis of rotation, and unwanted lateral or linear displacement of the housing 12 with respect to the impeller 36 along a direct perpendicular to the impeller axis of rotation. And, the angular displacement of frame struts 16 with respect to the axis of rotation of impeller 36 provides rigid axial support against unwanted lineal displacement between the housing and impeller along the direction defined by the impeller axis of rotation. Frame 14 also balances opposing forces acting against different portions of housing 12. Note for example, that the opposed axial forces transmitted by frame 14 to the rings 34 encircling inlets 18 and 20 exactly balance each other. These rings and frame 14 thus do not have to be prohibitively heavy or withstand extraordinary forces applied against the shaft of impeller 36 during operation of fan 10. And, lightweight embodiments of fan 10 will thus provide high efficiency and performance levels.

Figure 3:
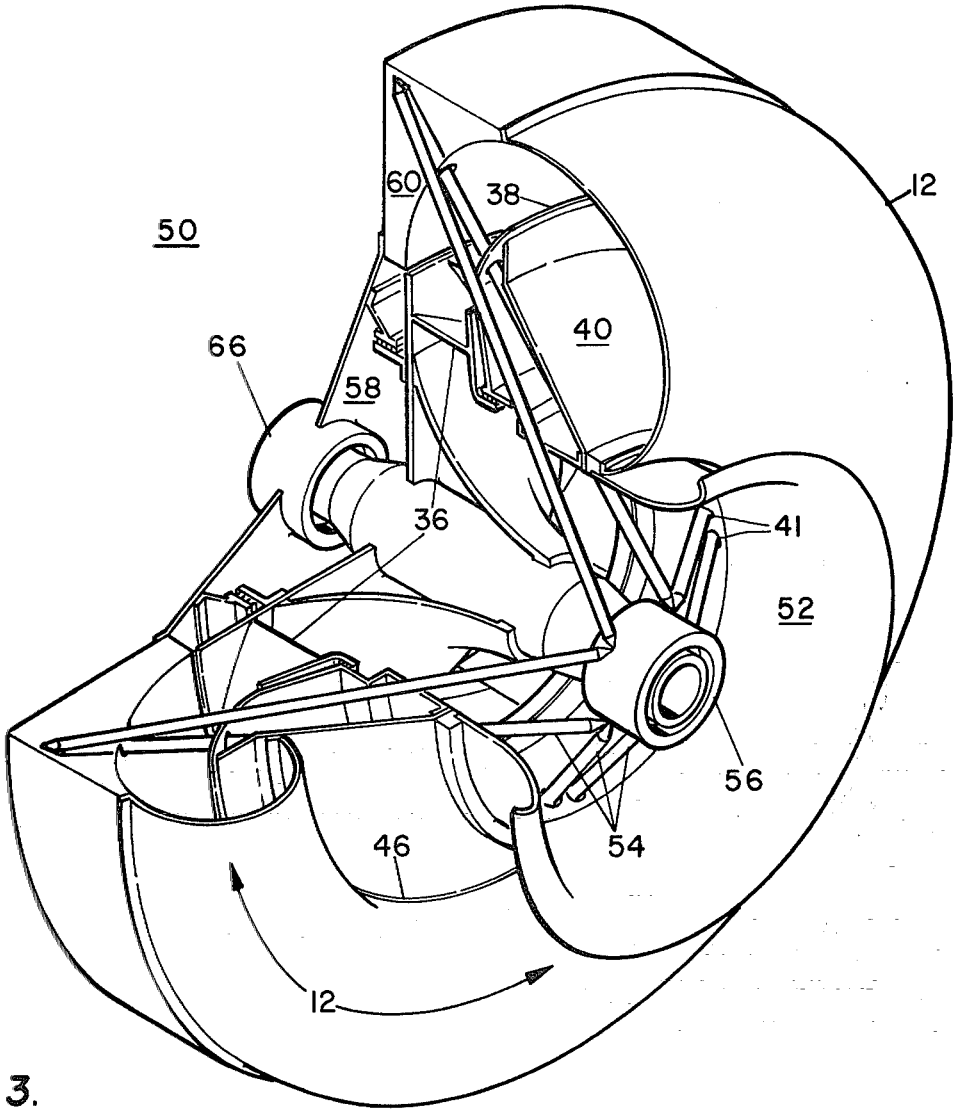
FIG. 3 is a schematic, partially cutaway, perspective illustration of a single inlet fan having a support frame formed from struts that extend across that inlet and the entire width of the fan housing.

FIG. 3 illustrates a fan 50 that differs from the fan 10 shown in FIG. 1, in that it includes only one air inlet 52, and support struts 54 that extend from a small diameter bearing 56 across opening 52 and the entire width of fan 50. This design requires a relatively strong backwall 58. And, the frame support ring of fan 50 corresponding to ring 24 in fan 10, has a right triangle cross-sectional shape to facilitate connection with this backwall instead of an isosceles configuration to facilitate connection with this backwall. That ring is designated by the numeral 60 instead of 24 because of this difference. And, struts 54 attach directly to ring 60 to illustrate a variation that can be used when the additional strength provided by clevises is not needed. But, except for these differences, the construction of fan 50 is generally similar to that of fan 10.

Operation of fan 50 is also generally similar to that of fan 10. Frame struts 54 do not distort the inlet air flow, and also provide good support, strength, and light weight. Note for example, that internal forces transferred by struts 54 to bearing 56 disposed in air inlet 52 are balanced by forces applied to backwall 58 and transmitted by that wall to bearing 66. There is thus the same balancing of pressures in fan 50 to prevent excessive forces against any component, or area during operation as that accomplished in fan 10.

Figure 4:
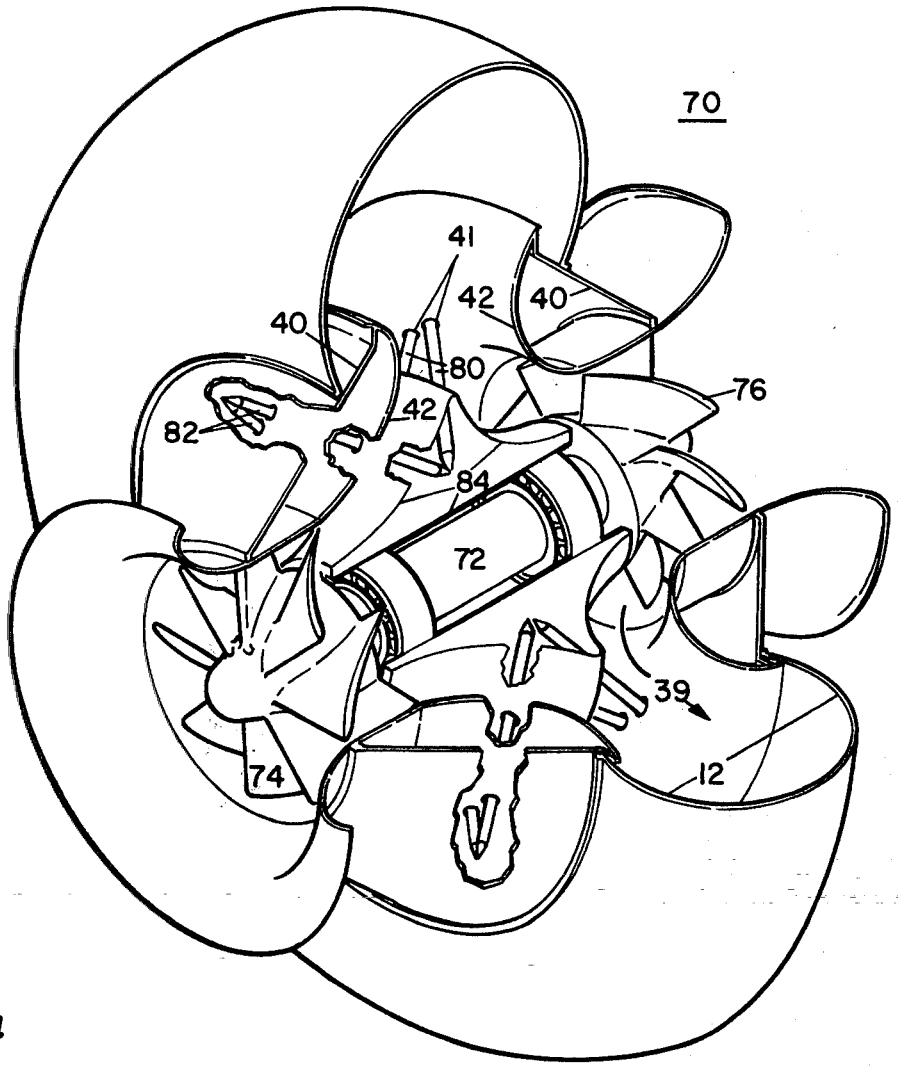
FIG. 4 is a schematic, partially cutaway, perspective illustration of a fan having a mixed flow impeller and a support frame in which strut members interconnect proximate that impeller.

FIG. 4 illustrates a double inlet fan 70 having an impeller 72 with two mixed flow blades 74 and 76, and a frame formed from struts 80 and 82 that extend from the housing 12 to intercept each other proximate impeller 72. Those struts are also connected to and supported by a ring 84 that is similar to ring 24 of fan 10, except that it encircles and abuts impeller 72 instead of housing 12. The operation and advantages of fan 70 are similar to the operation and advantages of fans 10 and 50 and need not be repeated. The impeller blades 74 and 76 are shaped so that air crosses them along a path midway between the parallel and perpendicular directions to the impeller axis of rotation. But, the surface of support ring 84 cooperates with the surfaces of diffuser elements 38 to define an air flow path downstream from impeller blades 74 and 76 that turns the air from a mixed flow direction to a radial flow through the diffuser slot 39 and into volute 12.

This invention can also be utilized in fans that differ from all of the designs illustrated in FIGS. 1–4. For example, a support frame in which the frame struts define a four-point star pattern has been discussed as a preferred construction. This provides a good balance between strength provided by the struts, and that required in other elements such as the triangular support ring, and the number of elements present to potentially interfere with the air flow. But, either more or fewer struts can be utilized, and may be clearly preferable in some embodiments. The hollow frame support rings can also be replaced with straight beams having rectangular cross sections and connecting consecutive points of the strut frame in some embodiments. In addition, it may not be desirable to have a constant velocity flow in some designs. And, further, even though it is important to prevent unwanted displacements between a fan impeller and its housing, those components need not be completely fixed and rigid with respect to each other. The features of this invention can be utilized in a fan designed so that either the rotor or a sleeve encircling that rotor can be moved axially with respect to the housing to vary the effective area of the flow path across the rotor. Many other straightforward variations of the examples illustrated herein will also be apparent to those skilled in this art.

Therefore, what is claimed is:

1. A fan comprising:

a bladed impeller;

a housing for said impeller defining a substantially enclosed area having at least one air inlet and one air outlet; and a housing support frame comprised of a plurality of struts disposed within said housing, at least one support ring supporting said struts, and means connecting said struts to said housing, each strut extending from said at least one support ring to said housing across the air flow path between said impeller blades and said air outlet at a non-orthoginal angle to said impeller, each end of said struts juxtatosed to an end of an adjacent strut to define a zig zag star shaped-pattern.

2. The fan of claim 1 in which:

said means connecting said struts to said housing include a second support ring; and said struts are positioned within said housing such that expansion of said housing by pressure produced within said housing by operation of said impeller places said struts in tension.

3. The fan of claim 1 in which:

said impeller is rotatable about an axis; said housing includes first and second sides displaced from each other along said impeller axis of rotation; said struts extend from said first side of said housing to positions intermediate said first and second sides; and said support frame further includes additional struts that extend from said second side of said housing to intercept said struts extending from said first side of said housing, said additional struts also being disposed at a non-orthoginal to said impeller and defining a zig zag star-shaped pattern within said housing.

4. The fan of claim 1 in which each of said struts defining said star-shaped pattern extend across substantially the entire axial width of said enclosed area.

5. The fan of claim 1 in which said star-shaped pattern is a four-point star pattern.

6. The fan of claim 2 in which said second support ring comprises a hollow support ring that encircles a portion of said impeller, has a triangular cross-sectional area, and is interconnected to said struts.

7. The fan of claim 1 in which:

said impeller has a fixed axis of rotation and is designed to move air in a radially outward direction from said axis;

said at least one air outlet is spaced radially from said impeller; and said housing has a snail shell-shaped outer surface that provides an air flow path whose cross-sectional area expands with displacement toward said at least one air outlet to accommodate constant velocity air flow.

8. The fan of claim 1 further including means defining a hollow diffuser having openings for receiving air from said impeller, so that said received air will provide a supporting air pressure within said diffuser that permits lightweight construction.

9. The fan of claim 8 in which:

said housing includes an annular frusto conical surface having a central opening comprising said at least one air inlet, and a volute attached to said annular frusto conical surface along a spiral that extends toward said central opening with displacement toward said air outlet;

said annular frusto conical surface and volute provide a snail shell-shape housing having a cross-sectional area that increases with displacement toward said air outlet; and said hollow diffuser is defined by a surface disposed between said frusto conical surface and said impeller that interconnects opposite edges of said annular frusto conical surface.

* * * * *